US006450601B1

(12) United States Patent
Pagnon et al.

(10) Patent No.: US 6,450,601 B1
(45) Date of Patent: Sep. 17, 2002

(54) INK JET PRINTER AND METHOD OF MANAGING THE INK QUALITY OF SUCH PRINTER

(75) Inventors: Alain Pagnon, Valence; Laurent Farlotti, Guilherand-Granges, both of (FR)

(73) Assignee: Imaje S.A., Bourg les Valence Cedax (FR)

( * ) Notice: Subject to any disclaimer, the term of this patent is extended or adjusted under 35 U.S.C. 154(b) by 0 days.

(21) Appl. No.: 09/558,651

(22) Filed: Apr. 26, 2000

(30) Foreign Application Priority Data

Apr. 28, 1999 (FR) ..... 99 05362

(51) Int. Cl.[7] ..... B41J 2/195
(52) U.S. Cl. ..... 347/7; 347/19; 347/89
(58) Field of Search ..... 347/6, 7, 14, 19, 347/85, 89, 73, 78; 222/54, 55, 57, 64

(56) References Cited

U.S. PATENT DOCUMENTS 4,714,931 A * 12/1987 Erskine et al. ..... 347/7
5,555,005 A * 9/1996 Pagnon ..... 347/6

FOREIGN PATENT DOCUMENTS

| | | |
|---|---|---|
| DE | 34 05 164 A1 | 8/1985 |
| EP | 0 287 372 A1 | 10/1988 |
| EP | 0 536 000 A2 | 4/1993 |

OTHER PUBLICATIONS

Patent Abstracts of Japan, Publication No. 59204563, Publication Date: Sep. 19, 1984.

* cited by examiner

*Primary Examiner*—Craig A. Hallacher
(74) *Attorney, Agent, or Firm*—Pearne & Gordon LLP

(57) ABSTRACT

This invention relates to an ink jet printer and a method of managing the ink quality of such a printer, wherein information on ink pressure P, temperature T, jet speed V, and the nominal ink characteristics ($\rho_n(T)$, $\mu_n(T)$) is available. When the machine is started for the first time, the ink jet is varied at its nominal value and the resulting pressure is measured so as to determine the values a and b characteristic of the ink circuit, the characteristics of the utilized ink $\rho(T)$, $\mu(T)$, and the difference in level between the print head and the pressure transducer H. These values allow to set the desired pressure value and to take corrective action on ink quality.

20 Claims, 4 Drawing Sheets

INK JET PRINTER AND METHOD OF MANAGING THE INK QUALITY OF SUCH PRINTER

TECHNICAL FIELD

This invention relates to an ink jet printer and a method of managing the ink quality of such printer.

BACKGROUND OF THE INVENTION

In an ink jet printer using the deflected continuous jet principle, the ink not used for printing is recycled. However, the recovered ink does not have the same properties as the ink emitted during the jet, mainly because of solvent evaporation.

Two documents, referenced as [1] and [2] at the end of the specification, describe methods of controlling ink quality drift. Indeed, solvent evaporation must be compensated by adding exactly the amount of evaporated solvent to keep ink quality constant. In order to ensure feedback control of this solvent addition without fluctuation (hunting), evaporation speed has to be taken into account.

In prior art, various types of feedback control (proportional, proportional-integral, proportional-integral-derivative, . . . ) can devise a solvent addition decision by affecting a weight distribution relating to:

- the present situation, or instantaneous difference between the desired value and the present operating pressure (proportional term);
- the past situation, e.g. by taking into account the differences recorded for recent operating hours (integral term);
- the future situation, or rather the trend of the present situation (derivative term).

These various types of feedback control are well adapted for managing ink quality. In particular, a wise choice of the relative weights of the various terms allows to improve speed and stability while avoiding oscillation (or "hunting"). The control principle of such feedback controls is well known to those skilled in the art.

The document referenced as [1] takes into account the measurement of the time the ink jet takes for draining a calibrated volume. A temperature sensor allows to take into account the natural influence of temperature on ink quality. Indeed, temperature has an effect on the ink's viscosity and density. The implemented feedback control uses the draining curve as a function of temperature. A reference point is set when the machine is started to account for dispersions among the various applications envisaged. However, such a method is only a rough one. Indeed, the theoretical analysis performed in this document [1] presumes independence of the ink's viscosity and density parameters, which is not correct: in fact, 80% of a printer's operating pressure is associated with ink density, so that even a small variation of this density may not be neglected with regard to the evolution of the pressure term due to viscosity. In addition, to keep ink quality constant, this document [1] considers a constant operating pressure. However, such constant pressure does not ensure constant jet speed over a wide operating range. Therefore, this method is restricted to a limited range of temperature evolution at the calibration point. In practice, a float is placed inside the pressurized reservoir feeding the jet (accumulator). Drainage time measurement is subject to the vagaries of the float (jamming, sticking, oscillation, . . . ). The accuracy and the repeatability of this kind of measurement are not good. Moreover, the measurement rate is very low (about ten per hour), so much so that a feedback control built with this type of detector is neither accurate nor fast.

In the document referenced as [2], the utilized machine comes with a specific device (ball viscometer) allowing to find out the ink viscosity of the machine. A viscosity/temperature curve translates the desired operating value. However, ink density evolution is by no means accounted for. This method is independent of the ink jet and does not call upon operating pressure. This machine operates at constant pressure and does not ensure constant writing quality for a wide temperature range. Moreover, such an implementation is costly because it uses a solenoid valve, a calibrated tube, a calibrated ball, detectors, tubing, etc.

Another method is described in the document referenced as [3]. It is based on the evolution of the operating pressure as a function of ink temperature by imposing a constant jet speed. This method not only ensures ink quality feedback control, but also maintains ink quality regardless of temperature, due to constant jet speed. It also performs jet speed measurement. The characteristic curve, which is the desired ink quality value, takes into account both ink viscosity and density. However, the implementation of this method requires that the difference in level between the head and the machine be known. Any error in this respect, not checked by the machine, results in a difference in ink quality and a deterioration of printing quality. In addition, this method requires operator action, and setting the reference pressure is done by varying the operating temperature of reference machines.

It is the object of the invention to compensate for the various disadvantages of the known art documents by providing a method of managing the ink quality of an ink jet printer, which by itself devises the desired operating value without any operator action.

SUMMARY OF THE INVENTION

This invention describes a method of managing the ink quality in an ink jet printer, wherein information relating to ink pressure P, temperature T, and jet speed V, and a desired pressure value curve $P_{consigne}$ as a function of temperature T and speed V is available, of the type:

$$P_{consigne}=a\times\rho_n(T)\times V^2+b\times\mu_n(T)\times V+\rho_n(T)\times g\times H$$

H being the difference in level between the print head and the pressure transducer, $\rho_n(T)$ and $\mu_n(T)$ characteristic curves of the nominal ink, a and b being characteristic values of the ink circuit and g gravity acceleration, characterized in that, when the machine is started, jet speed is varied at its nominal value and the resulting pressure $P(T)=a\times\rho(T)\times V^2+b\times\mu(T)\times V+\rho(T)\times g\times H$ is measured so as to determine the coefficients a, b, $\rho(T)$, $\mu(T)$, and H, and corrective action is taken for the ink quality to make $\rho$, $\mu$, and P close to $\rho_n$, $\mu_n$, and $P_{consigne}$ to the temperature T.

In a first operating mode, five independent values of the pair ($P_{fonct}$, V) are used to determine the five characteristics a, b, $\Delta P$, $\rho$, and $\mu$, with $P_{fonct}$ $a\rho V^2+b\mu V+\Delta P$, $\Delta P$ representing the difference in level term taken to be constant.

In a second operating mode, using the jet speeds V1 and V2, the straight line $(P_{fonct}(V1)-P_{fonct}(V2))/(V1-V2)$ as a function of V1+V2 is plotted using a linear regression, the coefficients $(a\times\rho)$ and $(b\times\mu)$ are obtained, then the average is calculated for the $\Delta P$'s associated with the set of measurements:

$$\Delta P_{stat}=1/n\times\Sigma_1^n(P_{fonct}(Vi)-a\times\rho\times Vi^2-b\times\mu\times Vi).$$

Advantageously, the coefficients a and b are known beforehand with sufficient accuracy for a given machine configuration from measurements performed on a sample machine and are stored in the memory of each machine produced.

Advantageously, the information regarding the ink is stored in fixed memory, e.g. as the following relations, for operation at constant concentration:

$$\rho_n(T)=\rho_n(T_0)*(1+\alpha\times(T-T_0))$$

$$\mu_n(T)/\mu_n(T_0)=1/(1+\beta\times(T-T_0))$$

with:

T: operating temperature $T_0$: any temperature within the operating range $\alpha$: coefficient reflecting fluid dilatancy $\beta$: coefficient reflecting fluid viscosity variation.

Advantageously, the values regarding $\rho_n(T)$ and $\mu_n(T)$ are tabulated as obtained from laboratory tests.

In a first alternative of a third operating mode, the ink circuit characteristics a and b are known, the parameters $P_{fonct}$, V, and T are measured, and $\Delta Pi=P_{fonct}(i)-a\times\rho(Td)\times Vi^2-b\times\mu(Td)\times Vi$ is calculated for various operating speeds, $$\Delta P_{calculé} = 1/n\times\sum_{1}^{n}\Delta Pi$$

is obtained and $$P_{consigne}(T)=\Delta P_{calculé}+a\rho(T)\times V^2+b\times\mu(T)\times V.$$

In a second alternative of the third operating mode:

$$\Delta P_{calculé}=(\rho_{réf}(T_d)\times g\times H)+(a\times V^2\times(\Delta\rho))+b\times V\times(\Delta\mu))$$

is obtained, with:

$\rho_{réf}(T)$: reference ink density $\mu_{réf}(T)$: reference ink viscosity $\rho_{encre}(T)$: utilized ink density $\mu_{encre}(T)$: utilized ink viscosity $\rho_{encre}(T)$: $\rho_{réf}(T)+\Delta\rho$ $\mu_{encre}(T)$: $\mu_{réf}(T)+\Delta\mu$ Advantageously, the information on utilized ink characteristics is contained in an electronic tag associated with the ink container. The values of $\Delta\rho$ and $\Delta\mu$ can then be calculated and allow the value of the difference in level H (only unknown value remaining from the equation of $\Delta P_{calculé}$) to be calculated precisely. These values ($\Delta\rho$, $\Delta\mu$) reflect the difference between the reference ink and the ink actually used by the machine. Relevant ($\Delta\rho$, $\Delta\mu$) values calculated both during when the printer is started for the first time and for successive restarts can highlight an ink destabilization problem, it is then appropriate to inform the user of the problem observed.

In a third alternative of the third operating mode, the difference in level is known (Hconnu), the determination of the desired pressure value then being trivial.

$$P_{consigne}=a\times\rho_n(T)\times V^2+b\times\mu_n(T)\times V+\rho_n(T)\times g\times Hconnu.$$

A specific instance of knowing the difference in level is a zero difference in level. This case is interesting for determining the hydraulic characteristics of a machine. In the latter case, measurement of the ink temperature $T_0$ as well as several measurements of the pair ($P_{fonct}$, V) are carried out by performing a jet speed scan, the ink flowing from the jet is retrieved and a measurement of ($\rho(T_0)$, $\mu(T_0)$) is performed for this ink, then ($P_{fonct}$)/V is plotted as a function of V, the best straight line reflecting the distribution of the pairs ($P_{fonct}$/V, V) in the diagram ($P_{fonct}$/V−V) is selected, the coefficient b is obtained by dividing the y-ordinate at the origin of the straight line by the measured viscosity $\mu(T_0)$ of the ink and the coefficient a by dividing the slope of the straight line by the measured density $\rho(T_0)$ of the ink.

Advantageously, the same pressure transducer for determining the desired value and for measuring the operating pressure, and a temperature sensor located in the print head, are used.

Advantageously, a programmable efficiency condenser is used, by varying the condenser power supply period.

Advantageously, the same operating mode is used each time the machine is restarted, ink quality drifts are monitored, and the user is informed of any abnormal evolution thereof.

This invention also relates to an ink jet printer comprising a recovery reservoir, solvent and ink adding devices driven by a control member via solenoid valves, pressure transducers, temperature and jet speed sensors, at the output of the print head, connected to said control member, an electric control pressure regulator and an electric control condenser, both driven by the control member, and condenser power supply modulation means.

Therefore, the inventive method uses the relation linking operating pressure and ink quality. In order to obtain virtually invariable print quality for the whole operating temperature range of the machine (typically from 0 to 50° C.), operation takes place at constant jet speed. The pressure required for obtaining this jet speed is compared with a reference pressure. This difference in current operating pressure and reference pressure reflects the evolution of ink quality. Advantageously, the inventive method allows to set the reference pressure based on information contained in fixed memory and on a start-up sequence consisting in jet speed scanning, and measuring the various associated pressures. Thus, this reference pressure is set autonomously by the machine, which has the following advantages:

- Reference pressure setting is not done, as with prior art devices, by varying the operating temperature of reference machines, as the means for such an operation are considerable and expensive, in addition, the dispersion of head losses from one machine to another as well as the difference among the utilized sensors being measuring error sources.
- As the operating pressure and reference pressure are the result of measurements performed with the same transducer, all the differences associated with transducer non-repeatability is done away with.
- The information characterizing the machine's hydraulics and required for setting the reference pressure can be obtained at any operating temperature because these characteristics are temperature independent.
- The information characterizing the ink and required for setting the reference pressure, provided by the ink formulator, is obtained from laboratory measurements.
- Partial use of the method allows stand-alone operation of the machine, which computationally determines the difference in level between the ink circuit portion and the print head.
- The method is particularly well suited to circuits for which repeatability of hydraulic nozzle characteristics is ensured, e.g. using nozzles obtained through electrodeposition, electrodischarge machining or laser drilling. The machine then produces the formulator's ink from the ink contained in the reservoir (ink cartridge). This advantage is considerable from the industry's point of view because the tolerances associated with ink production are extended. Thus, industrial ink production is made easier without penalizing machine operation. Moreover, the consistency of operator information and machine calculation is controlled by the machine's software. The major risk of sign errors for this head/circuit difference in level is thus avoided.

In case of ink type modification (color, type), all that has to be done is replace the characteristics of the old ink with those of the new one in order to be operational.

DETAILED DESCRIPTION OF THE EMBODIMENTS

In an ink jet printer, the relationship linking operating pressure and ink quality is the sum of four terms: a kinetic energy term $a\rho V^2$, a viscous friction term $b\mu V$, a potential energy term $\rho gh$, and a term associated with fluid surface tension. The latter surface tension term is negligible in comparison with the other terms: it represents less than 2% of operating pressure and varies little with temperature.

Operating pressure can therefore be written as $$P_{fonct} \# a \times \rho \times V^2 + b \times \mu \times V + \rho \times g \times H,$$

with:

a: coefficient of hydraulic circuit singular head loss b: coefficient of hydraulic circuit regular head loss $\rho$: ink density $\mu$: dynamic ink viscosity V: ink jet speed g: gravity acceleration (about 10 $m/s^2$)

H: difference in level between the ink circuit and the print head.

The most important term is the kinetic energy term $a \times \rho \times V^2$ (about 70 to 80% at nominal temperature). The evolution of this term is associated with the evolution of density $\rho$ as a function of temperature T, because jet speed is considered to be constant, and a as independent of the temperature T.

The viscous friction term $b\mu V$ represents 15 to 20% of the operating pressure $P_{fonct}$ at ambient temperature, but its evolution with temperature T is significant. This evolution is directly linked to that of the ink's viscosity depending on the operating temperature, V and b being independent of temperature T.

The potential energy term $\rho gh$ represents at most 10% of the pressure for the whole operating range. It varies little with temperature T, and as it represents a low percentage of pressure, it can be considered as constant. The error thus made is limited to several mBar and is therefore negligible.

It is therefore possible to write: $P_{fonct} \# a \times \rho \times V^2 + b \times \mu \times V + \Delta P$, $\Delta P$ representing the difference in level term taken to be constant and necessarily known. Two cases are possible:

the difference in level between the ink circuit and the print head is specified by the operator;

this term is calculated by the machine.

Figure 1:
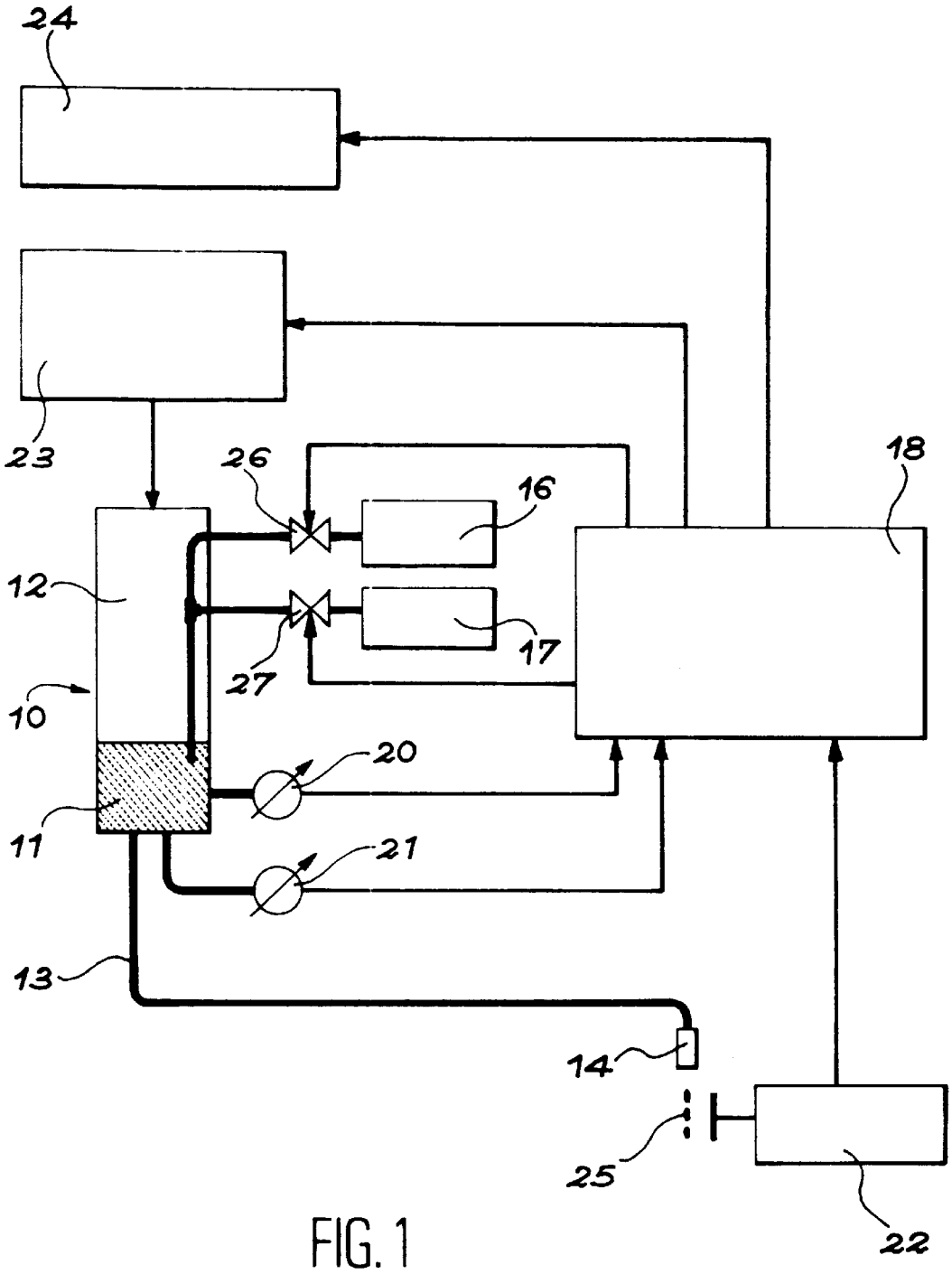
FIG. 1 illustrates a simplified diagram of an ink jet printer according to the invention.

In the inventive method, operating pressure $P_{fonct}$, jet speed V, and temperature T are measured to obtain the desired pressure value of the utilized machine as a function of the operating temperature: $P_{fonct} = P_{fonct}(T)$ FIG. 1 thus illustrates a simplified diagram of an ink jet printer according to the invention. It comprises a reservoir 10 containing a certain ink volume 11, the remaining volume 12 being filled with air, a line 13 linking this reservoir 10 to the print head 14, solvent and ink adding devices 16 and 17 driven by a control member 18 via solenoid valves 26 and 27, pressure, temperature and jet speed 25 sensors 20, 21, and 22 of head 14 connected to this control member 18, an electric control pressure regulator 23 as well as an electric control condenser 24, both driven by control member 18.

Figure 2:
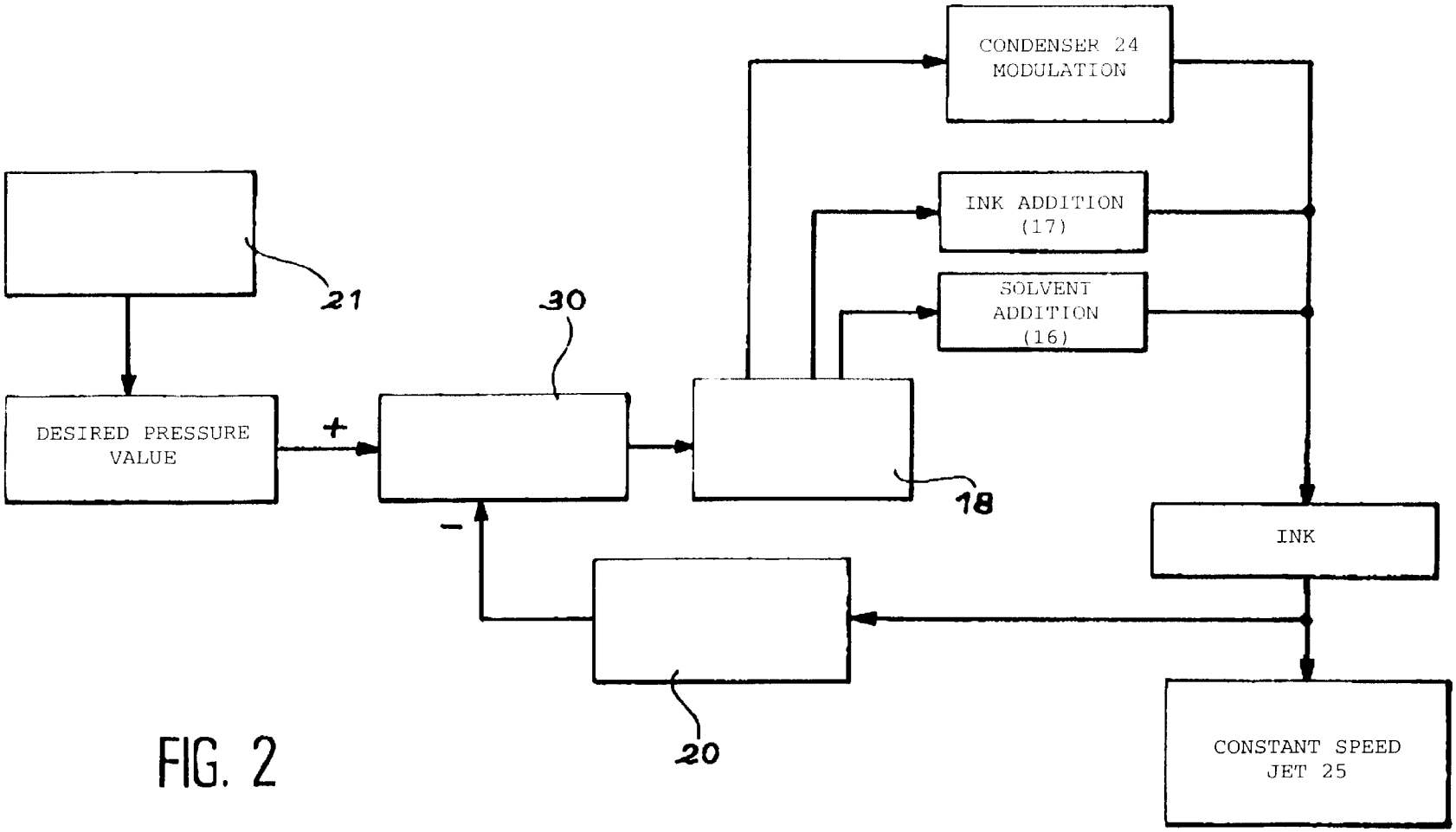
FIG. 2 illustrates a simplified diagram of an feedback control of the ink quality in the printer illustrated in FIG. 1.

FIG. 2 illustrates a simplified diagram of an ink quality feedback control, according to the invention, in such a printer. A comparator 30 devises a difference between the desired pressure obtained using the temperature sensor 21 output signal and the real operating pressure obtained at the output of pressure transducer 20. This difference in pressure is processed by the software of control member 18, which, by means of appropriate actions, such as the addition of solvent, addition of ink, condenser control modulation, allows this difference in pressure to be limited.

Ink temperature measurement can be performed at the ink circuit. However, most of the head loss (over 90% of the desired pressure value) being associated with the nozzle, measuring the ink temperature at the print head (nozzle holder) allows to obtain even more precise information.

In the inventive method, when the machine is started for the first time, jet speed is varied at its nominal speed and the values $P_{fonct}$, V, and T are recorded. This starting step only takes a few seconds, so that for this short period, the ink temperature remains virtually constant and is $T_{démarrage}$ (or $T_d$). The inventive method allows to retrieve all the characteristics a, b, $\Delta P$ for the ink circuit and $\rho$ and $\mu$ for the utilized ink.

Figure 3:
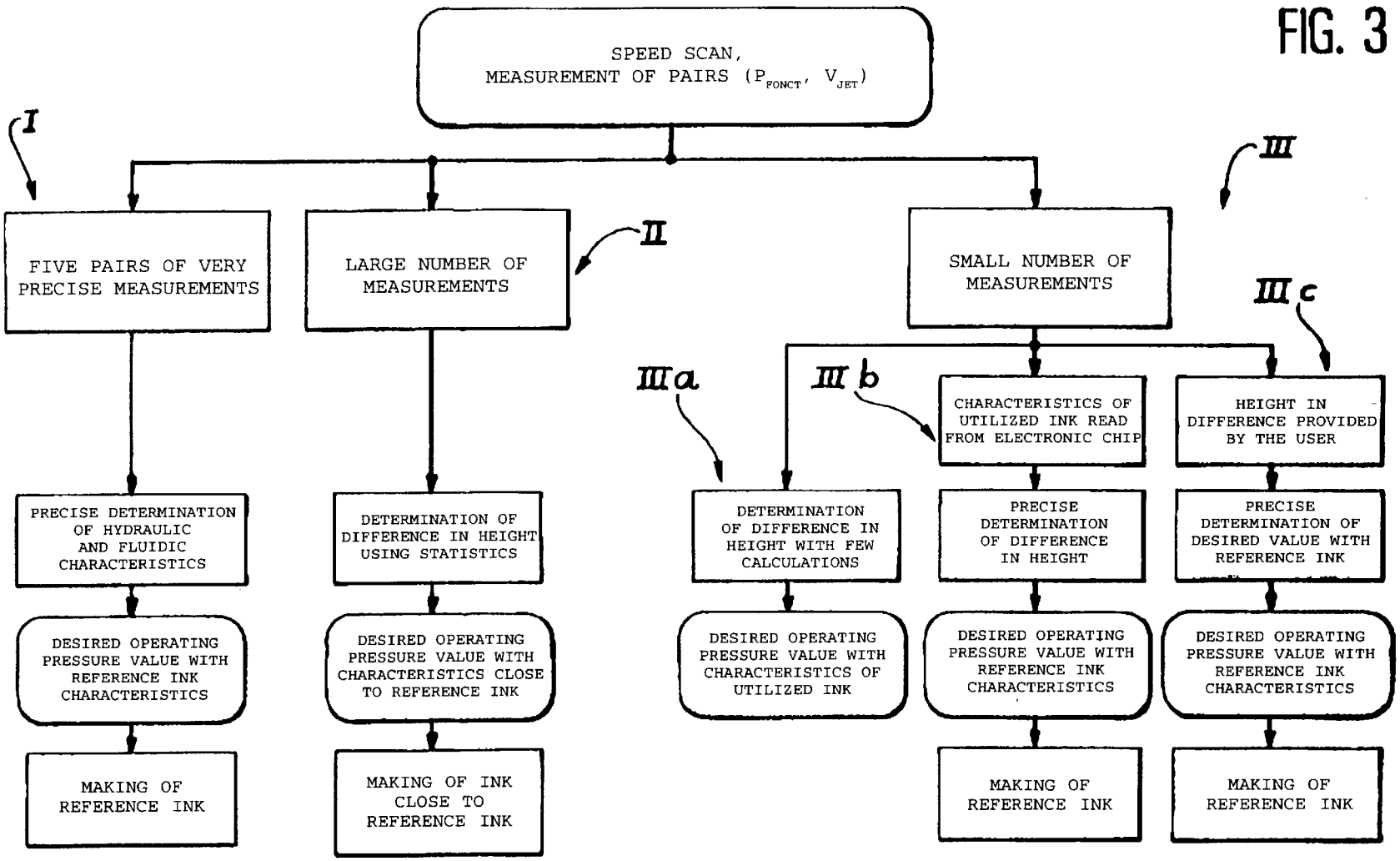
FIG. 3 illustrates all the various embodiments of the inventive method.

The inventive method comprises several embodiments, illustrated in FIG. 3, which will be explained below.

First Embodiment (I)

In a first embodiment (I), five independent values of the pair ($P_{fonct}$, V) are used to determine these five characteristics a, b, $\Delta P$, $\rho$, $\mu$. Five measurements of the operating pressure $P_{fonct}$ are performed for five values of the jet speed V centered on the nominal speed value. Then, a system of five equations is solved to finally obtain the values a, b, $\Delta P$, $\rho$, $\mu$. However, such an embodiment is highly dependent on the accuracy of the measurements of $P_{fonct}$ and V.

Second Embodiment (II)

In a second embodiment (II), statistical calculations are performed. Two jet speeds V1 and V2 are used. The relationship linking the two variables $(P_{fonct}(V1)-P_{fonct}(V2))/(V1-V2)$ and $(V1+V2)$ is $(P_{fonct}(V1)-P_{fonct}(V2))/(V1-V2) = a \times \rho \times (V1+V2) + b \times \mu$. Then, $(P_{fonct}(V1)-P_{fonct}(V2))/(V1-V2)$ is plotted as a function of $(V1+V2)$ using a linear regression (least squares principle). The coefficients of the straight line thus obtained are then directly $(a \times \rho)$ and $(b \times \mu)$. The calculation of $\Delta P$ is then performed by averaging the $\Delta P$'s associated with the set of measurements. With $(P_{fonct}(Vi)$, V(i)) for i=1 to n representing the set of measurements, ΔP is calculated with the following relation:

$$\Delta P_{stat}=1/n\times\Sigma_1^n(P_{fonct}(Vi)-a\times\rho\times Vi^2-b\times\mu\times Vi).$$

The characteristics of the reference ink being known for the machine, this calculated $\Delta P_{stat}$ is required and sufficient for setting the desired pressure. This embodiment allows both to limit the need for accuracy when measuring jet speed V and to reduce the dispersive effects of the set of measurement errors, via the use of statistics.

The implementation of the print head nozzle by electrodeposition or electrodischarge machining allows to obtain a remarkable hydraulic repeatability. And yet, 90% of the circuit's head loss is due to the nozzle; the two head loss coefficients a and b therefore have very low dispersion for all the machines. These coefficients, independent of temperature T, can therefore be measured on sample machines and their mean values stored in the memory of each machine produced.

The information on reference ink, also stored in the machine's memory, can be stored as the following relations, for operation at constant concentration:

$$\rho_n(T)=\rho_n(T_0)*(1+\alpha\times(T-T_0))$$

$$\mu_n(T)/\mu_n(T_0)=1/(1+\beta\times(T-T_0))$$

with:

T: operating temperature $T_0$: any temperature within the operating range (generally the temperature of the laboratory when the relation is determined)

α: coefficient reflecting fluid dilatancy

β: coefficient reflecting fluid viscosity variation.

The values concerning ($\rho_n$(T), $\mu_n$(T)) can also be tabulated as obtained from laboratory tests.

For certain inks, the low temperature range (typically less than 10° C.) is associated with high fluid viscosity. Such a viscosity results in a recovery problem of the ink not used for printing and an evolution of the fragment quality possibly leading to a drift in printing performance. In order to compensate for these disadvantages, the laws (ρ(T), μ(T)) can be adapted, e.g. by choosing μ(T)=μ(10) for T<10° C. Thus, in the range T<10° C., the desired constant concentration ink becomes constant viscosity ink. It is then possible to determine the desired pressure value with the following relation:

$$P_{consigne}(T)=\Delta P_{stat}+a\times\rho_n(T)\times V^2+b\times\mu_n(T)\times V.$$

The main advantage of this second embodiment is the total determination of all parameters.

Third Embodiment (III)

A third embodiment (III) is possible when part of the parameters are known, e.g. a and b. Then the parameters $P_{fonct}$, V, and $T=T_{démarrage}=T_d$ are measured. Knowing a and b, and the relations ρ(T) and μ(T), it is possible to calculate:

$$\Delta P=P_{fonct}-a\times\rho(T_d)\times V^2 b\times\mu(T_d)\times V.$$

The calculation is done for various operating speeds. For speed values $V_i$ located on either side of the nominal speed, $P_{fonct(i)}$ is measured and $$\Delta Pi=P_{fonct(i)}-a\times\rho(T_d)\times V_i^2-b\times\mu(T_d)\times V_i$$

is calculated.

When the machine is started for the first time, the jet speed is varied at the nominal speed and then, as many ΔP's are calculated as there are values of the pair ($P_{fonct}$, V). The mean ΔP value obtained by averaging the (measured) ΔP's allows to reduce the errors associated in particular with the measuring speed V.

In a first alternative (III.a) of this third embodiment, ΔP is then obtained by the averaging formula:

$$\Delta P_{calculé}=1/n\times\sum_1^n\Delta Pi$$

E.g., for a nominal speed of 20 m/s, the operating pressure is measured for the speeds $V_i$=19 m/s; 19.5 m/s; 20 m/s; 20.5 m/s, and 21 m/s (n=5).

When $\Delta P_{calculé}$ has been calculated, the characteristic curve is obtained easily, from mere calculation, by applying the following relation:

$$P_{consigne}(T)=\Delta P_{calculé}+a\times\rho_{réf}(T)V^2+b\times\mu_{réf}(T)\times V.$$

For managing ink quality, the operating pressure $P_{fonct}$, temperature T, and jet speed V are therefore measured. The calculation of $P_{consigne}$(T) is then instantaneous and the difference ($P_{fonct}-P_{consigne}$(T)) can be used directly by the feedback control, of whatever type it may be.

The machine itself then builds its desired pressure value by considering its first start ink as equivalent to the reference ink. The relation, which allows to obtain the value $\Delta P_{calculé}$, calls upon ($\rho_{ref}$(T), $\mu_{ref}$(T)), which is information on reference ink developed by the formulator and the characteristics of which have been measured at the laboratory. Indeed, the industrially mass produced ink is adapted for use with a printer, but has considerably different characteristics.

The value $\Delta P_{calculé}$ mainly represents the pressure term associated with the difference in level, but it also reflects the difference of the characteristics between the reference ink and the ink utilized by the machine. By considering the ink utilized by the machine as equivalent to the reference ink, $\Delta P_{calculé}$ directly reflects the difference in level.

In a second alternative (III.b) of this third embodiment, the difference in characteristics is corrected. For this purpose, it is noted:

$\rho_{réf}$(T): Reference ink density $\mu_{réf}$(T): Reference ink viscosity $\rho_{encre}$(T): (Industrially) utilized ink density $\mu_{encre}$(T): (Industrially) utilized ink viscosity The reference ink and utilized ink formulations being sufficiently close, their respective coefficients α and β, which reflect the evolution of their characteristics as a function of temperature, are virtually identical.

The operating value of the machine with the reference ink is:

$$P_{réf}\text{consigne}=a\times\rho_{réf}(T)\times V^2+b\times\mu_{réf}(T)\times V+\rho_{réf}(T)\times g\times H.$$

The pressure value of the machine set with the utilized and previously defined ink is:

$$P\text{consigne}=a\times\rho_{réf}(T)\times V^2+b\times\mu_{réf}(T)\times V+\Delta P_{calculé}.$$

The value $\Delta P_{calculé}$ is set when the machine is started for the first time. The ink temperature is then $T_{démarrage}=T_d$ and for each jet speed $V_i$, $$P_{fonct}(i)=a\times\rho_{encre}(T_d)\times V_i^2+b\times\mu_{encre}(T_d)\times V_i+\rho_{encre}(T_d)\times g\times H$$

is obtained.

Through identification:

$$\Delta P_i=\rho_{encre}(T_d)\times g\times H+a\times V_i^2\times(\rho_{encre}(T_d)-\rho_{réf}(T_d))+b\times V_i\times(\mu_{encre}(T_d)-\mu_{réf}(T_d))$$

is thus obtained.

The values of Vi being close and centered on the nominal speed V, the value $\Delta P_{calculé}$ obtained by averaging $\Delta P_i$'s can be approximated by:

$$\Delta P_{calculé}=\rho_{encre}(T_d)\times g\times H+a\times V^2\times(\rho_{encre}(T_d)\rho_{réf}(T_d))+b\times V\times(\mu_{encre}(T_d)\rho_{réf}(T_d)).$$

The characteristics of the reference and utilized inks being close, $$\rho_{encre}(T_d)=\rho_{réf}(T_d)+\Delta\rho \text{ and } \mu_{encre}(T_d)=\mu_{réf}(T_d)+\Delta\mu$$

can be noted.

The error for the term at H (difference in level) is very low if $\rho_{encre}(T_d)$ and $\rho_{réf}(T_d)$ are merged. Thus, it is possible to write $$\Delta P_{calculé}=(\rho_{réf}(T_d)\times g\times H)+(a\times V^2\times(\Delta\rho)+b\times V\times(\Delta\mu)).$$

The value $\Delta P_{calculé}$ therefore reflects both the difference in height between the print head and the ink circuit and the difference of the ink characteristics.

It is possible to write $\Delta P_{calculé}=\Delta P_H+\Delta P_{encre}$.

$\Delta P_H$: Term reflecting the difference in level.

$\Delta P_{encre}$: Term reflecting the difference in characteristics between the utilized ink and the reference ink.

The information on the characteristics of the utilized ink obtained from measurements performed directly at the ink production line, can be contained in an electronic tag, as in the document referenced as [4], associated with the ink container. This electronic tag can furthermore contain other relevant information regarding the ink (use-by date, liquid quantity of the container, ink part number, . . . ). The characteristics $(\rho_{réf}(T), \mu_{réf}(T))$ and $(\rho_{encre}(T), \mu_{encre}(T))$ can be read automatically by the machine. As the machine knows the reference ink characteristics, it is then possible to calculate $\Delta P_{encre}$ easily, the calculation of $\Delta P_{calculé}$ remaining unchanged. The difference $(\Delta P_{calculé}\times\Delta P_{encre})$ directly produces $\Delta P_H$. The desired pressure value is then given by:

$$P_{consigne}=a\times\rho_{réf}(T)\times V^2+b\times\mu_{réf}(T)\times V+\Delta P_H.$$

This desired value used by the feedback control allows to cancel the value of $\Delta P_{encre}$. The machine then makes a reference ink from a considerably different ink.

In a third alternative (III.c) of the third embodiment, the difference in level is known, the operator can for instance inform the machine of the exact position of the head with respect to the machine at start-up, the desired value being then known without any calculation.

$$P_{consigne}=a\times\rho_{réf}(T)\times V^2+b\times\mu_{réf}(T)\times V+\rho_{réf}(T)\times g\times H$$

is obtained.

Thus, the method presented in document [3] is improved, because $\Delta P_{calculé}$ and $\Delta P_H$ can be calculated. The term $\Delta P_{encre}$ can then be calculated: $\Delta P_{encre}=\Delta P_{calculé}-\Delta P_H$. This term can be reduced to 0 by the feedback control, so that the machine will make the reference ink from a similar (but not identical) ink. Moreover, when the machine is restarted with an unchanged difference in level condition (no evolution of machine setup), this term ΔPencre can be calculated and the user be informed if the value of this term exceeds a given limit.

In a particular case, operation is done at zero difference in level (ΔP=0), thus simplifying the relation giving the operating pressure. The relationship linking operating pressure divided by jet speed is then linear as a function of this jet speed.

For ΔP=0:

$$P_{fonct}(T)=a\times\rho(T)\times V^2+b\times\mu(T)\times V,$$

and therefore $$P_{fonct}(T)/V=a\times\rho(T)\times V+b\times\mu(T)$$

is obtained.

By plotting Pfonct(T)/V as a function of V and applying a linear adjustment (e.g. using the least squares method), the ordinate at the origin represents (b×μ) and the slope of the straight line is (a×ρ). The practical implementation of this alternative is easy and particularly adapted to the laboratory determination of the hydraulic parameters (a, b) of a machine. For a given machine, all that has to be done is to impose a zero difference in level and to perform the measurement of the ink temperature $T_0$ and several measurements of the pair ($P_{fonct}$, V) by a jet speed scan. Then, $(P_{fonct})/V$ is plotted as a function of V, the best straight line is selected (e.g. applying the least squares method) reflecting the distribution of the pairs ($P_{fonct}/V$, V) in the diagram ($P_{fonct}/V-V$). For the principle to be applied in a laboratory, the ink flowing from the jet is retrieved and this ink is subjected to a measurement of $(\rho(T_0), \mu(T_0))$. The coefficient b is obtained easily by dividing the ordinate at the origin of the straight line by the ink's measured viscosity $\mu(T_0)$. The coefficient a is obtained easily by dividing the slope of the straight line by the ink's measured density $\rho(T_0)$.

The application of this alternative to several machines has shown:

low dispersion for coefficients a and b;

the possibility to retrieve within a couple of minutes the characteristic curves of the existing machines, whereas in known art, these characteristic curves of the existing machines are established by placing these machines into an oven, establishing such curves in the oven requiring many working hours.

Advantageously, in the various operating modes, the inventive method allows for obtaining maximum autonomy, calculating the actual difference in level between machine and print head, and making the characteristics of the utilized ink evolve towards those of the reference ink. This method allows to accurately compensate differences of 1% in density and 10% in viscosity for industrially produced ink. The inventive method allows to set the desired value of ink quality feedback control, reducing the difference between the desired pressure and operating value.

On traditional ink circuits, feedback control can be active for correctly managing solvent addition, wherein solvent concentration reduction is driven by natural evaporation. Feedback control has a limited ink addition capacity to reduce solvent concentration, but the amount of solvent to evaporate remains unchanged, only the difference in concentration is reduced. Moreover, as the circuit's internal volume is limited, adding ink can only be done with a restricted and limited quantity to avoid the risk of one of the reservoirs spilling over. Furthermore, the reaction time of the ink quality feedback control being all the better as the quantity of ink is low, adding ink does not go into the right direction.

Figure 4:
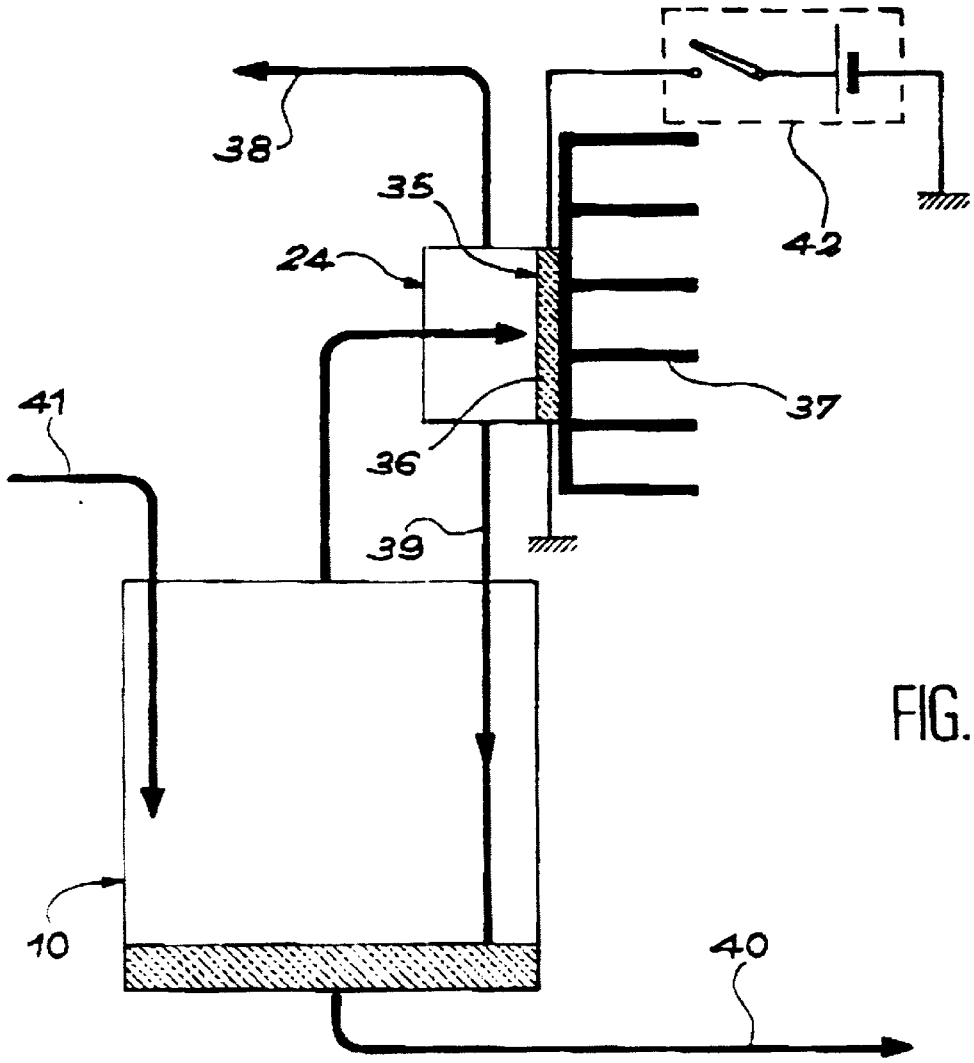
FIG. 4 illustrates a condenser providing solvent recovery in the inventive method.

In order to solve such a problem, a programmable efficiency condenser 24 can be used, which allows to recover and reinject into the ink circuit a large part of the evaporated solvent. The solvent recovery capacity is varied by modulating the condenser's power supply. FIG. 4 illustrates solvent recovery with a Peltier effect condenser 24, having a Peltier effect cell 35, a cold surface 36, a hot surface (radiator) 37, the air outlet 38, the recovered solvent output 39, the pump feed 40, the recovered ink return 41, and the power supply 42 of condenser 24.

Figure 5:
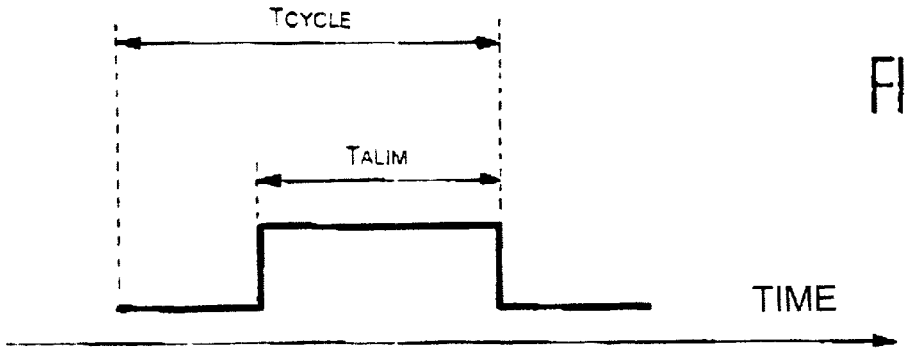
FIG. 5 illustrates a sample modulation of the condenser of FIG. 4.

In FIG. 5, the power supply modulation of this condenser 24 is shown, obtained by varying the $T_{alim}$ period with respect to the $T_{cycle}$ period. Here, modulation is associated with a power supply duty cycle. It would also be possible to vary the supply voltage level of condenser 24.

Thus modulating the efficiency of condenser 24 allows to reduce the feedback control reaction time. Consequently, to compensate for excessive solvent concentration, the condenser's efficiency can be reduced (or even cancelled). Thereby, the performance of the ink quality feedback control is improved. Such efficiency modulation is particularly adapted to the starting phases when thermal conditions are still in a transient phase. Applications for which short thermal cycles are observed also benefit from variable condenser efficiency.

The various embodiments of the inventive method allow the desired operating pressure value to be set. This desired value is set when the machine is started for the first time. Reusing the same operating mode when the machine is restarted has several interesting aspects. In particular, it is possible to check ink characteristics when the machine is restarted and, possibly, inform the printer user of an ink quality drift.

Basically, two types of ink quality drifts are observed. The evolution of the two parameters viscosity and density can take place in parallel and naturally. E.g., an increase both in viscosity and density is noted. This first type of evolution, if it stays within acceptable limits, does not reflect an ink problem but a natural drift associated e.g. with the ink being stored under off-limit conditions with respect to specifications. It is therefore acceptable for the machine that will be able to compensate for natural differences. Another possibility for the ink relates to an opposite evolution of density and viscosity. The latter type of evolution is abnormal and generally reflects an ink stability problem (flocculation, deposits, . . . ). The interest of such a characteristic is that it is possible to inform the user as soon as possible so that he can purge his machine and restart it with proper ink. Thus, an ink problem does not take on disastrous proportions for the machine and will not durably interfere with the user's production flow. The user is sure of the good quality of the ink.

REFERENCES

[1] EP-O 333 325

[2] EP-O 142 265

[3] FR-2 636 884

[4] FR-2 744 391

What is claimed is:

1. A method of managing the ink quality in an ink jet printer, wherein information on ink pressure P, temperature T, and jet speed V, and a desired pressure value curve $P_{consigne}$ as a function of temperature T and speed V is available, of the type:

$$P_{consigne}=a\times\rho_n(T)\times V^2+b\times\mu_n(T)\times V+\rho_n(T)\times g\times H$$

H being the difference in level between the print head and the pressure transducer, $\rho_n(T)$ and $\mu_n(T)$ characteristic curves of the nominal ink, a and b being characteristic values of the ink circuit and g gravity acceleration, characterized in that, when the machine is started, jet speed is varied at its nominal value and the resulting pressure $P(T)=a\times\rho(T)\times V^2+b\times\mu(T)\times V+\rho(T)\times g\times H$ is measured so as to determine the coefficients a, b, $\rho(T)$, $\mu(T)$, and H, and corrective action is taken for the ink quality to make $\rho$, $\mu$, and P close to $\rho_n$, $\mu_n$, and $P_{consigne}$ to the temperature T.

2. The method according to claim 1, wherein five independent values of the pair ($P_{fonct}$, V) are used to determine the five characteristics a, b, $\Delta P$, $\rho$, and $\mu$, with $P_{fonct}=a\rho V^2+b\mu V+\Delta P$, $\Delta P$ representing the difference in level term taken to be constant.

3. The method according to claim 1, wherein the jet speeds V1 and V2 are used, the straight line $(P_{fonct}(V1)-P_{fonct}(V2))/(V1-V2)$ as a function of V1+V2 is plotted using a linear regression, the coefficients $(a\times\rho)$ and $(b\times\mu)$ are obtained, then the average is calculated for the $\Delta P$'s associated with the set of measurements:

$$\Delta P_{stat}=1/n\times\Sigma_i^n(P_{fonct}(Vi)-a\times\rho\times Vi^2-b\times\mu\times Vi).$$

4. The method according to claim 1, wherein the coefficients a and b are known beforehand with sufficient accuracy for a given machine configuration from the measurements performed at a sample machine and are stored in the memory of each machine produced.

5. The method according to claims 1 to 4, wherein the information on nominal ink is stored in fixed memory.

6. The method according to claim 5, wherein such information is stored as the following relations, for operation at constant concentration:

$$\rho_n(T)=\rho_n(T_0)*(1+\alpha\times(T-T_0))$$

$$\mu_n(T)/\mu_n(T_0)=1/(1+\beta\times(T-T_0))$$

with:

T: operating temperature $T_0$: any temperature within the operating range $\alpha$: coefficient reflecting fluid dilatancy $\beta$: coefficient reflecting fluid viscosity variation.

7. The method according to claim 5, wherein the values regarding $\rho_n(T)$ and $\mu_n(T)$ are tabulated as obtained from laboratory tests.

8. The method according to claim 1, wherein, in a laboratory, a zero difference in level is imposed, and the measurement of ink temperature $T_0$ and several measurements of the pair ($P_{fonct}$, V) are carried out by performing a jet speed scan, the ink flowing from the jet is retrieved and this ink is subjected to a measurement of $(\rho(T_0), \mu(T_0))$, $(P_{fonct})/V$ is then plotted as a function of V, the best straight line reflecting the distribution of the pairs ($P_{fonct}/V$, V) in the diagram ($P_{fonct}/V-V$) is selected, the coefficient b is obtained by dividing the ordinate at the origin of the straight line by the measured viscosity $\mu(T_0)$ of the ink and the coefficient by dividing the slope of the straight line by the measured density $\rho(T_0)$ of the ink.

9. The method according to claim 1, wherein the ink circuit characteristics a and b are known, parameters $P_{fonct}$, V, and T are measured, $\rho(T_d)$, $\mu(T_d)$ and H are calculated; then the desired pressure value is derived therefrom:

$$P_{consigne}=a\times\rho_n(T)\times V^2+b\times\mu_n(T)\times V+\rho_n(T)\times g\times H.$$

10. The method according to claim 1, wherein the ink circuit characteristics a and b are known, machine ink is considered as equivalent to the reference ink, parameters $P_{foncr}$, V, and T are measured, and $$\Delta Pi = P_{foncr}(i) - a \times \rho_n(Td) \times Vi^2 - b \times \mu_n(Td) \times Vi$$

is calculated for various operating speeds, $$\Delta P_{calculé} = 1/n \times \sum_{1}^{n} \Delta Pi$$

is obtained and $$P_{consigne}(T) = \Delta P_{calculé} + a\rho_n(T) \times V^2 + b \times \mu_n(T) \times V.$$

11. The method according to claim 1, wherein:

$$\Delta P_{calculé} \mathbf{32}\ (\rho_{réf}(T_d) \times g \times H) + (a \times V^2 \times (\Delta\rho)) + b \times V \times (\Delta\mu))$$

is obtained, with:

$\rho_{réf}$(T): reference ink density $\mu_{réf}$(T): reference ink viscosity $\rho_{encre}$(T): utilized ink density $\mu_{encre}$(T): utilized ink viscosity $\rho_{encre}$(T): $\rho_{réf}$(T)+$\Delta\rho$ $\mu_{encre}$(T): $\mu_{réf}$(T)+$\Delta\mu$.

12. The method according to claim 11, wherein the ink circuit characteristics (a, b) are known, and the difference in level being provided by the user, the desired pressure value is derived therefrom, parameters $P_{foncr}$, V, and T are measured, and the difference ($\Delta\rho$, $\Delta\mu$) between the utilized ink and the reference ink is calculated.

13. The method according to any of claims 1 to 12, wherein the information on utilized ink characteristics is contained in an electronic tag associated with the ink container.

14. The method according to any of claims 1 to 13, wherein the same pressure transducer is used for determining the desired value and measuring the operating pressure.

15. The method according to any of claims 1 to 13, wherein a temperature sensor located in the print head is used.

16. The method according to any of claims 1 to 14, wherein a programmable efficiency condenser is used.

17. The method according to claim 16, wherein the condenser's power supply period is varied.

18. The method according to any of claims 1 to 17, wherein the same operating mode is used each time the machine is restarted.

19. The method according to claim 18, wherein ink quality drifts are monitored, and wherein the user is informed of any abnormal evolution thereof.

20. The method according to claim 18, wherein the evolution of the difference in level is monitored, and the user can be prompted to confirm the observed evolution.

* * * * *

UNITED STATES PATENT AND TRADEMARK OFFICE

CERTIFICATE OF CORRECTION

PATENT NO. : 6,450,601 B1 
DATED : September 17, 2002
INVENTOR(S) : Alain Pagnon et al.

It is certified that error appears in the above-identified patent and that said Letters Patent is hereby corrected as shown below:

Title page,
Item [56], References Cited, OTHER PUBLICATIONS, please delete "Sep. 19, 1984", and insert therefor -- Nov. 19, 1984 --.

Column 3,
Line 8, before the first occurrence of "$\rho_n$", please insert -- * --.
Line 10, before the first occurrence of "$\mu_n$", please insert -- * --.

Column 6,
Line 11, after "(T)", please insert -- . --.

Column 7,
Line 24, before the first occurrence of "$\rho_n$", please insert -- * --.
Line 25, before the first occurrence of "$\mu_n$", please insert -- * --.
Line 58, after "$V^2$", please insert -- - -- (minus).

Column 9,
Line 10, after the second occurrence of "($T_d$)", please insert -- - -- (minus).
Line 11, please delete "$\rho_{réf}$", and insert therefor -- $\mu_{réf}$ --.
Line 42, please delete "($\Delta P_{calculé}$ x $\Delta P_{encre}$)",
and insert therefor -- ($\Delta P_{calculé}$ - $\Delta P_{encre}$) --.

Column 12,
Line 33, before the first occurrence of "$\rho_n$", please insert -- * --.
Line 35, before the first occurrence of "$\mu_n$", please insert -- * --.

UNITED STATES PATENT AND TRADEMARK OFFICE

CERTIFICATE OF CORRECTION

PATENT NO. : 6,450,601 B1 
DATED : September 17, 2002
INVENTOR(S) : Alain Pagnon et al.

It is certified that error appears in the above-identified patent and that said Letters Patent is hereby corrected as shown below:

Column 13,
Line 16, please delete "32".

Signed and Sealed this

Twenty-eighth Day of January, 2003

JAMES E. ROGAN
*Director of the United States Patent and Trademark Office*